US007555797B1

(12) United States Patent
Wu

(10) Patent No.: US 7,555,797 B1
(45) Date of Patent: Jul. 7, 2009

(54) INFLATABLE BED ADAPTED FOR USE WITH A SOFA

(76) Inventor: Hsin-Tsai Wu, 1F., No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 12/193,313

(22) Filed: Aug. 18, 2008

(30) Foreign Application Priority Data

Jan. 24, 2008 (CN) ..... 2008 2 0043455 U

(51) Int. Cl.
*A47C 27/10* (2006.01)
*A47C 7/00* (2006.01)

(52) U.S. Cl. ..... 5/710; 706/712; 706/12.1; 706/925

(58) Field of Classification Search ..... 5/710, 5/706, 711, 712, 12.1, 12.2, 925, 655.3, 722
See application file for complete search history.

(56) References Cited

U.S. PATENT DOCUMENTS

D180,063 S * 4/1957 Burton et al. ..... D6/604
4,442,556 A * 4/1984 Craigie ..... 5/13
4,694,515 A * 9/1987 Rogers, Jr. ..... 5/13
6,161,231 A * 12/2000 Kraft et al. ..... 5/18.1
D507,445 S * 7/2005 Song et al. ..... D6/604
7,246,393 B2 * 7/2007 Westendorf et al. ..... 5/706
7,331,074 B2 * 2/2008 Wu ..... 5/706
2003/0024050 A1 * 2/2003 Boso et al. ..... 5/711
2005/0273937 A1 * 12/2005 Chen ..... 5/706
2007/0199153 A1 * 8/2007 Wu ..... 5/706

* cited by examiner

*Primary Examiner*—Alexander Grosz
(74) *Attorney, Agent, or Firm*—Caesar, Rivise, Bernstein, Cohen & Pokotilow, Ltd.

(57) ABSTRACT

An inflatable bed is adapted for use with a sofa, and includes an upper inflatable pad unit disposed on and connected to a lower inflatable pad body, and having a bridging unit that is misaligned from the lower inflatable pad body in a vertical direction and that has a bottom surface adapted to face a seat surface of the sofa when the bridging unit is disposed on the seat surface of the sofa. Two auxiliary inflatable pad bodies are attached respectively on opposite lateral ends of the bridging unit of the upper inflatable pad unit. Each auxiliary inflatable pad body is adapted to fill a space between the bridging unit of the upper inflatable pad unit and a corresponding arm of the sofa when the bridging unit of the upper inflatable pad unit is disposed on the seat surface of the sofa.

9 Claims, 5 Drawing Sheets

INFLATABLE BED ADAPTED FOR USE WITH A SOFA

CROSS-REFERENCE TO RELATED APPLICATION

This application claims priority of Chinese Application No. 200820043455.1, filed on Jan. 24, 2008.

BACKGROUND OF THE INVENTION

1. Field of the Invention

The invention relates to an inflatable bed, more particularly to an inflatable bed adapted for use with a sofa.

2. Description of the Related Art

Referring to FIG. 1, a conventional inflatable bed 100 is shown to be used with a sofa 4' that has a seat surface 40'. The conventional inflatable bed 100 includes a lower inflatable pad unit 101, and an upper inflatable pad body 102 disposed on and connected to the lower inflatable pad unit 101. The upper inflatable pad body 102 has a bridging end portion 1021 misaligned from the lower inflatable pad unit 101 in a vertical direction. In use, the bridging end portion 1021 of the upper inflatable pad body 102 is disposed on the seat surface 40' of the sofa 4'.

However, since the bridging end portion 1021 of the upper inflatable pad body 102 does not fully cover the seat surface 40' of the sofa 4', undesirable displacement of the conventional inflatable bed 100 cannot be avoided during use.

SUMMARY OF THE INVENTION

Therefore, the object of the present invention is to provide an inflatable bed adapted for use with a sofa that can overcome the aforesaid drawback of the prior art.

According to the present invention, there is provided an inflatable bed adapted for use with a sofa that has a seat surface, and opposite arms flanking the seat surface. The inflatable bed comprises:

a lower inflatable pad body;

an upper inflatable pad unit disposed on and connected to the lower inflatable pad body, and having a bridging unit that is misaligned from the lower inflatable pad body in a vertical direction and that has a bottom surface adapted to face the seat surface of the sofa when the bridging unit is disposed on the seat surface of the sofa; and two auxiliary inflatable pad bodies attached respectively on opposite lateral ends of the bridging unit of the upper inflatable pad unit, each of the auxiliary inflatable pad bodies being adapted to fill a space between the bridging unit of the upper inflatable pad unit and a corresponding one of the arms of the sofa when the bridging unit of the upper inflatable pad unit is disposed on the seat surface of the sofa.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
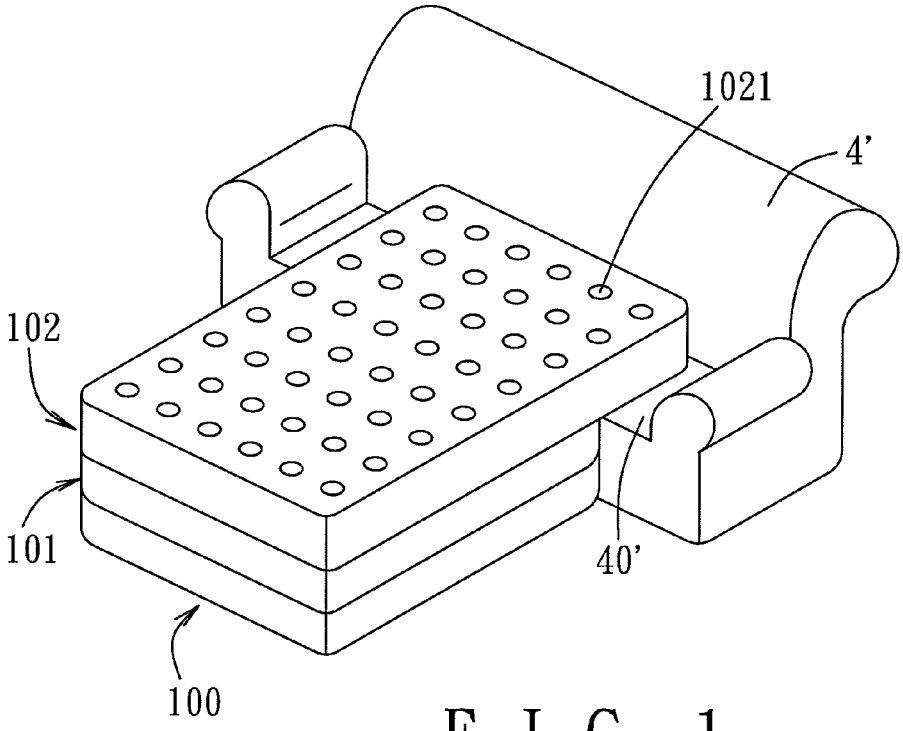
F I G. 1 PRIOR ART
FIG. 1 is a perspective view of an assembly of a conventional inflatable bed and a sofa.

Before the present invention is described in greater detail, it should be noted that like elements are denoted by the same reference numerals throughout the disclosure.

Figure 2:
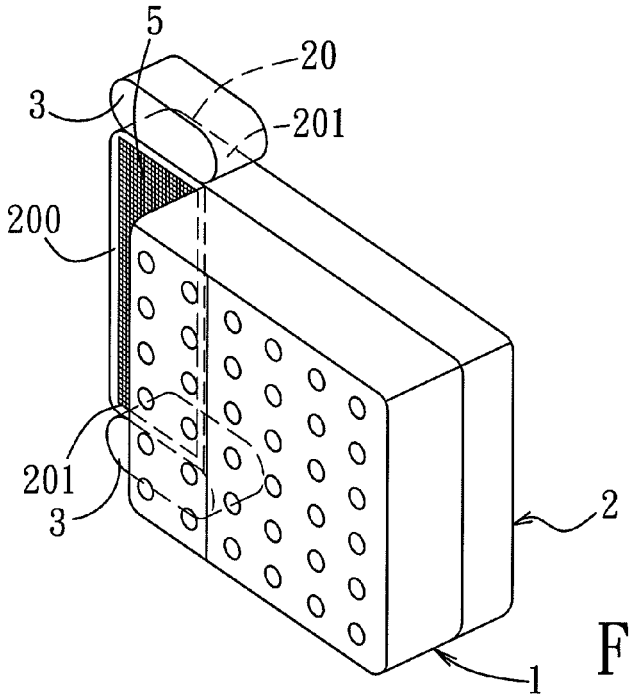
FIG. 2 is a perspective bottom view showing the first preferred embodiment of an inflatable bed according to the present invention.
Figure 3:
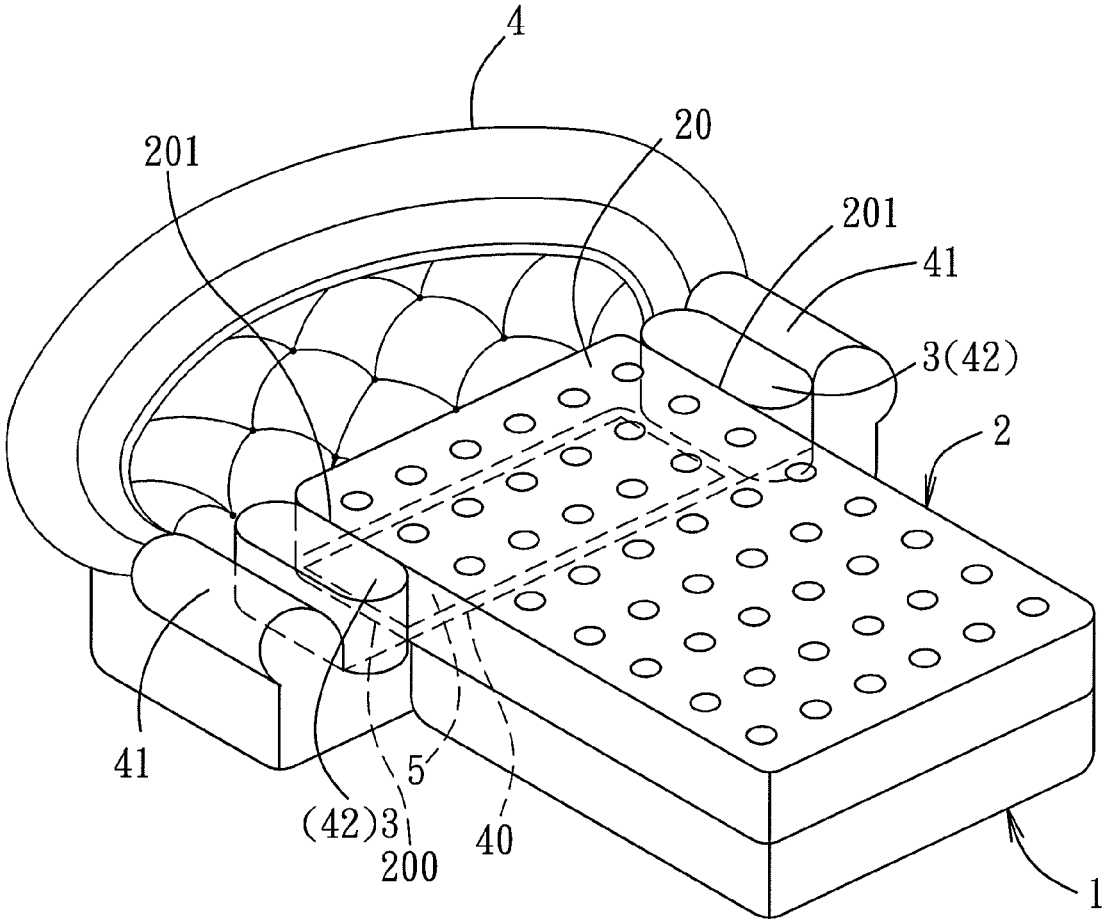
FIG. 3 is a perspective view showing the first preferred embodiment when used with a sofa.

Referring to FIGS. 2 and 3, the first preferred embodiment of an inflatable bed according to the present invention is shown to be adapted for use with a sofa 4. The sofa 4 has a seat surface 40, and opposite arms 41 flanking the seat surface 40. The inflatable bed includes a lower inflatable pad body 1, an upper inflatable pad unit, two auxiliary inflatable pad bodies 3, and an anti-slip unit 5.

The upper inflatable pad unit is disposed and is connected to the lower inflatable pad body 1. In this embodiment, the upper inflatable pad unit includes a main inflatable pad body 2 stacked on the lower inflatable pad body 1 and having an end portion 20 that serves as a bridging unit of the upper inflatable pad unit and that is misaligned from the lower inflatable pad body 1 in a vertical direction. The end portion 20 of the main inflatable pad body 2 has opposite lateral ends 201, and a bottom surface 200 adapted to face the seat surface 40 of the sofa 4 when the end portion 20 is disposed on the seat surface 40 of the sofa 4, as shown in FIG. 3. In this embodiment, the end portion 20 of the main inflatable pad body 2 has an identical thickness.

The auxiliary inflatable pad bodies 3 are attached respectively on the lateral ends 201 of the end portion 20 of the main inflatable pad body 2. Each auxiliary inflatable pad body 3 is adapted to fill a space 42 between the end portion 20 of the main inflatable pad body 2 and a corresponding one of the arms 41 of the sofa 4 when the end portion 20 of the main inflatable pad body 2 is disposed on the seat surface 40 of the sofa 4. In this embodiment, each auxiliary inflatable pad body 3 has an inflatable space independent from that of the main inflatable pad body 2 such that the inflatable bed of the present invention can fit the sofa 4 having various sizes by adjusting the amount of air filled in the auxiliary inflatable pad bodies 3.

The anti-slip unit 5 is attached on a bottom surface of the bridging unit of the upper inflatable pad unit, i.e., the bottom surface 200 of the end portion 20 of the main inflatable pad body 2.

It is noted that, due to the presence of the auxiliary inflatable pad bodies 3 and the anti-slip unit 5, the bridging unit of the upper inflatable pad unit, i.e., the end portion 20 of the main inflatable pad body 2, can be effectively positioned on the seat surface 40 of the sofa 4. Therefore, undesirable displacement encountered in the prior art can be avoided during use.

Figure 4:
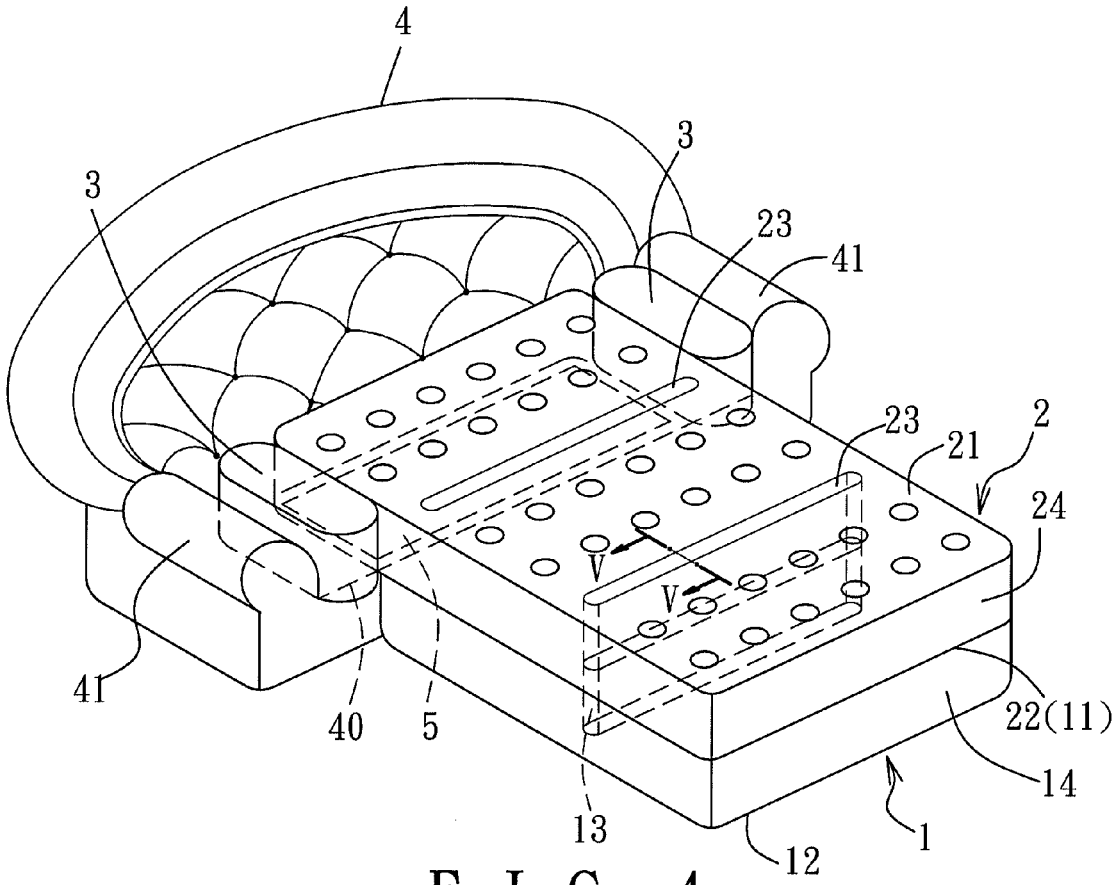
FIG. 4 is a perspective view showing an assembly of the sofa and the second preferred embodiment of an inflatable bed according to the present invention.
Figure 5:
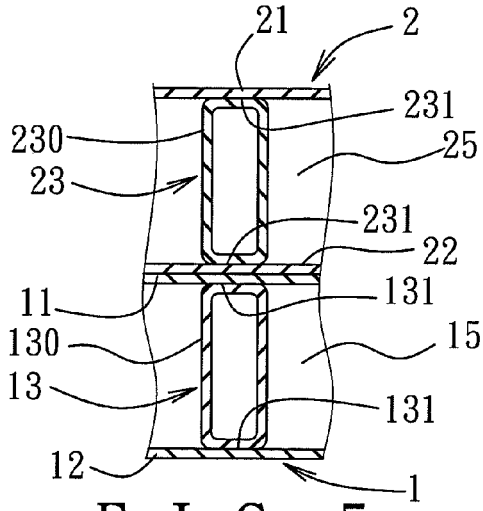
FIG. 5 is a schematic sectional view of the second preferred embodiment taken along line V-V in FIG. 4.

FIGS. 4 and 5 illustrate the second preferred embodiment of an inflatable bed according to this invention, which is a modification of the first preferred embodiment.

In this embodiment, the lower inflatable pad body 1 has a top layer 11, a bottom layer 12, and a looped surrounding layer 14 interconnecting the top and bottom layers 11, 12 and cooperating with the top and bottom layers 11, 12 to define an inflatable space 15 thereamong. Similarly, the main inflatable pad body 2 of the upper inflatable pad unit has a top layer 21, a bottom layer 22, and a looped surrounding layer 24 interconnecting the top and bottom layers 21, 22 and cooperating with the top and bottom layers 21, 22 to define an inflatable space 25 thereamong.

The lower inflatable pad body 1 includes a tubular reinforcing belt 13 disposed in the inflatable space 15 therein and extending along a horizontal direction. As shown in FIG. 5, the tubular reinforcing belt 13 has a looped outer surface 130 that has opposite elongate attaching areas 131 abutting respectively against the top and bottom layer 11, 12 of the lower inflatable pad body 1. A periphery of each attaching area 131 of the tubular reinforcing belt 13 is attached fixedly to a corresponding one of the top and bottom layers 11, 12 of the lower inflatable pad body 1.

The main inflatable pad body 2 of the upper inflatable pad unit includes two tubular reinforcing belts 23 disposed in the inflatable space 25 therein and extending along the horizontal direction, wherein one of the tubular reinforcing belts 23 is disposed adjacent to the end portion 20, and the other one of the tubular reinforcing belts 23 is aligned with the tubular reinforcing belt 13 of the lower inflatable pad body 1 in the vertical direction. As shown in FIG. 5, each tubular reinforcing belt 23 has a looped outer surface 230 that has opposite elongate attaching areas 231 abutting respectively against the top and bottom layer 21, 22 of the main inflatable pad body 2. A periphery of each attaching area 231 of each tubular reinforcing belt 23 is attached fixedly to a corresponding one of the top and bottom layers 21, 22 of the main inflatable pad body 2. It is noted that, after air in the inflatable bed of the present invention is exhausted, the inflatable bed can be easily folded along the reinforcing belts 13, 23 serving as folding lines.

Figure 6:
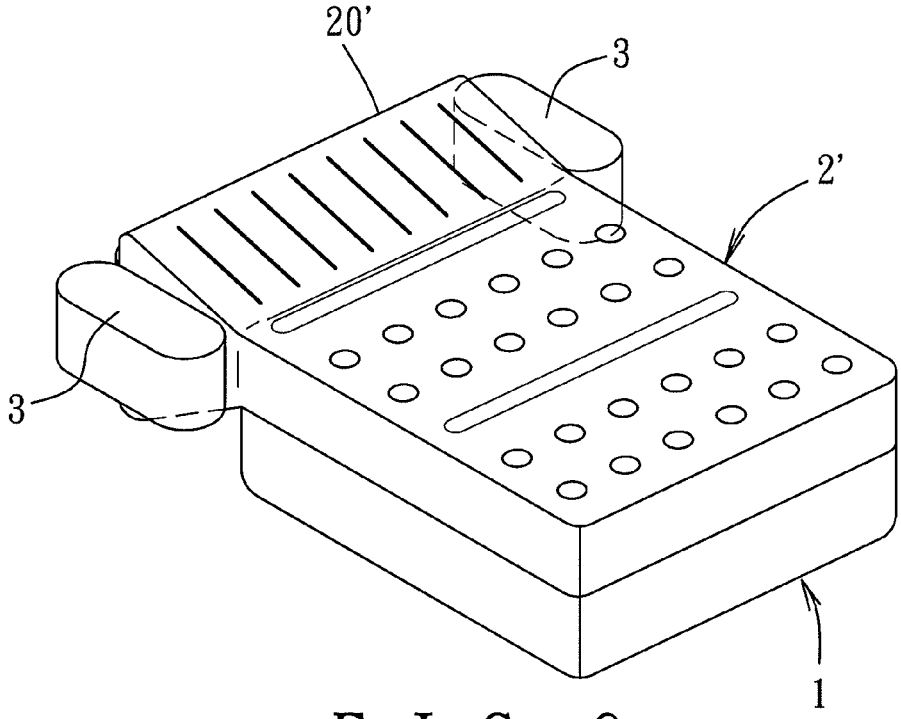
FIG. 6 is a perspective view showing the third preferred embodiment of an inflatable bed according to the present invention.
Figure 7:
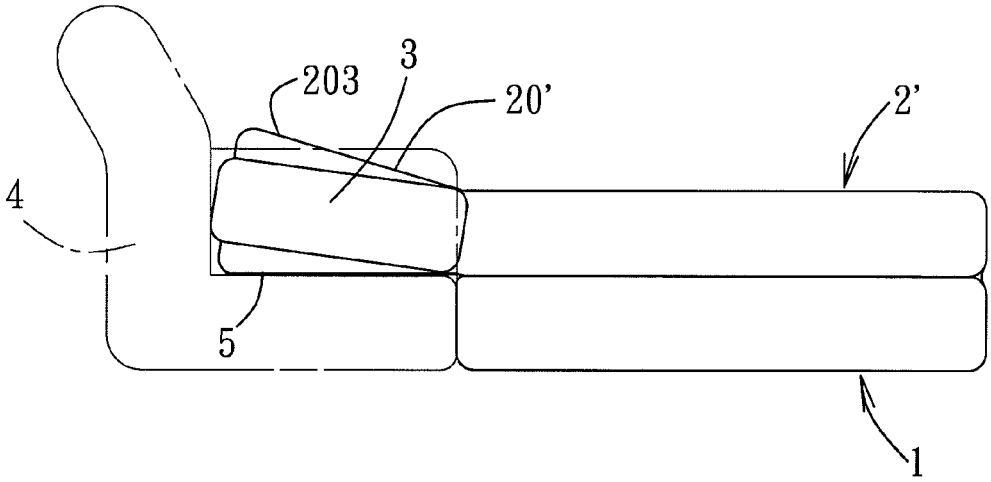
FIG. 7 is a schematic side view showing the third preferred embodiment when used with the sofa.

FIGS. 6 and 7 illustrate the third preferred embodiment of an inflatable bed according to this invention, which is a modification of the second preferred embodiment.

In this embodiment, the end portion 20' of the main inflatable pad body 2' of the upper inflatable pad unit, i.e., the bridging unit of the upper inflatable pad unit, has a thickness that gradually increases in a direction away from the lower inflatable pad body 1 such that the end portion 20' of the main inflatable pad body 2' has an inclined top surface 203 when the end portion 20' of the main inflatable pad body 2' is disposed on the seat surface 40 of the sofa 4, as shown in FIG. 7.

Figure 8:
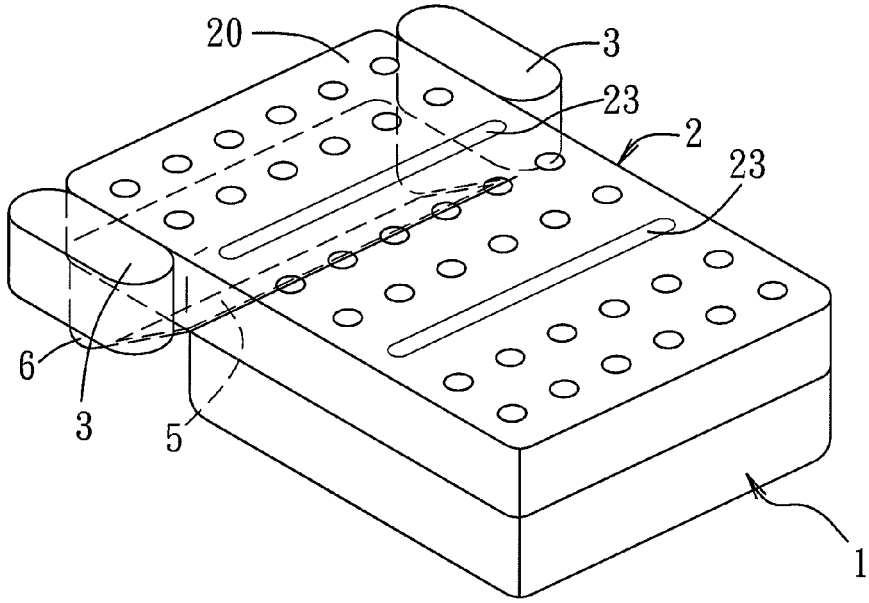
FIG. 8 is a perspective view showing the fourth preferred embodiment of an inflatable bed according to the present invention.
Figure 9:
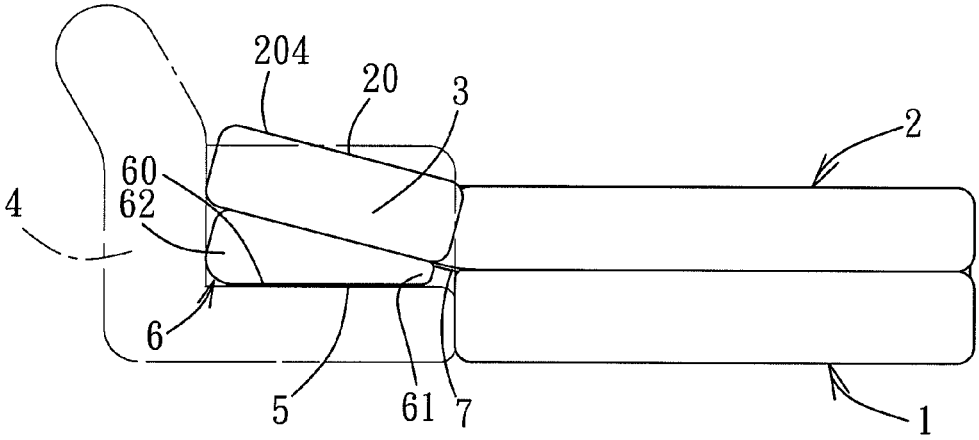
FIG. 9 is a schematic side view showing the fourth preferred embodiment when used with the sofa.

FIGS. 8 and 9 illustrate the fourth preferred embodiment of an inflatable bed according to this invention, which is a modification of the second preferred embodiment. In this embodiment, the upper inflatable pad unit further includes an adjusting inflatable pad body 6, and a connecting member 7.

The adjusting inflatable pad body 6 is disposed under the end portion 2 of the main inflatable pad body 2, and has a connecting end 61 disposed adjacent to the lower inflatable pad body 1, a free end 62 opposite to the connecting end 61, and a thickness that gradually increases in a direction toward the free end 62, as shown in FIG. 9.

The connecting member 7 interconnects the connecting end 61 of the adjusting inflatable pad body 6 and the end portion 20 of the main inflatable pad body 2. The connecting member 7 can be a zipper (not shown) having two zipper halves connected fixedly and respectively to the connecting end 61 of the adjusting inflatable pad body 6 and the end portion 20 of the main inflatable pad body 2, and engaging detachably each other.

It is noted that, in this embodiment, the end portion 20 of the main inflatable pad body 2 and the adjusting inflatable pad body 6 constitute the bridging unit of the upper inflatable pad unit. The adjusting inflatable pad body 6 has a bottom surface 60 that serves as the bottom surface of the bridging unit of the upper inflatable pad unit that is attached with the anti-slip unit 5.

When the bridging unit is disposed on the seat surface 40 of the sofa 4, the bridging unit has a top surface 204 that has an inclination angle changeable by adjusting the amount of air filled in the adjusting inflatable pad body 6.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An inflatable bed adapted for use with a sofa that has a seat surface, and opposite arms flanking the seat surface, said inflatable bed comprising:

a lower inflatable pad body;

an upper inflatable pad unit disposed on and connected to said lower inflatable pad body, and having a bridging unit that is misaligned from said lower inflatable pad body in a vertical direction and that has a bottom surface adapted to face the seat surface of the sofa when said bridging unit is disposed on the seat surface of the sofa; and two auxiliary inflatable pad bodies attached respectively on opposite lateral ends of said bridging unit of said upper inflatable pad unit, each of said auxiliary inflatable pad bodies being adapted to fill a space between said bridging unit of said upper inflatable pad unit and a corresponding one of the arms of the sofa when said bridging unit of said upper inflatable pad unit is disposed on the seat surface of the sofa.

2. The inflatable bed as claimed in claim 1, further comprising an anti-slip unit attached on said bottom surface of said bridging unit of said inflatable pad unit.

3. The inflatable bed as claimed in claim 1, wherein said upper inflatable pad unit includes a main inflatable pad body stacked on said lower inflatable pad body and having an end portion that is misaligned from said lower inflatable pad body in the vertical direction.

4. The inflatable bed as claimed in claim 3, wherein said end portion of said main inflatable pad body serves as said bridging unit.

5. The inflatable bed as claimed in claim 3, wherein:

each of said lower inflatable pad body and said main inflatable pad body having a top layer, a bottom layer, and a looped surrounding layer interconnecting said top and bottom layers and cooperating with said top and bottom layers to define an inflatable space thereamong; and each of said lower inflatable pad body and said main inflatable pad body includes at least one tubular reinforcing belt disposed in said inflatable space and extending along a horizontal direction, said tubular reinforcing belt of each of said lower inflatable pad body and said main inflatable pad body having a looped outer surface that has opposite elongate attaching areas abutting respectively against said top and bottom layers of a respective one of said lower inflatable pad body and said main inflatable pad body, a periphery of each of said attaching areas of said tubular reinforcing belt of each of said lower inflatable pad body and said main inflatable pad body being attached fixedly to a corresponding one of said top and bottom layers of the respective one of said lower inflatable pad body and said main inflatable pad body.

6. The inflatable bed as claimed in claim 5, wherein said main inflatable pad body includes two of said tubular reinforcing belts, one of which is disposed adjacent to said end portion, and the other one of which is aligned with said tubular reinforcing belt of said lower inflatable pad body in the vertical direction.

7. The inflatable bed as claimed in claim 3, wherein said end portion of said main inflatable pad body has a uniform thickness.

8. The inflatable bed as claimed in claim 3, wherein said end portion of said main inflatable pad body has a thickness that gradually increases in a direction away from said lower inflatable pad body such that said end portion of said main inflatable pad body has an inclined top surface when said end portion of said main inflatable pad body is disposed on the seat surface of the sofa.

9. The inflatable bed as claimed in claim 3, wherein:

said upper inflatable pad unit further includes an adjusting inflatable pad body disposed under said end portion of said main inflatable pad body, said adjusting inflatable pad body having a connecting end disposed adjacent to said lower inflatable pad body, a free end opposite to said connecting end, and a thickness that gradually increases in a direction toward said free end, a connecting member for interconnecting said adjusting inflatable pad body and said main inflatable pad body;

said end portion of said main inflatable pad body and said adjusting inflatable pad body constitute said bridging unit, said adjusting inflatable pad body having a bottom surface that serves as said bottom surface of said bridging unit; and when said bridging unit is disposed on the seat surface of the sofa, said bridging unit has atop surface that has an inclination angle changeable by adjusting the amount of air filled in said adjusting inflatable pad body.

* * * * *